US007055471B2

(12) United States Patent
Chittenden

(10) Patent No.: US 7,055,471 B2
(45) Date of Patent: Jun. 6, 2006

(54) HYDRAULIC LIFTER FEED GALLERY WITH AERATION REMOVAL ORIFICE

(75) Inventor: Jonathan Richard Chittenden, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 304 days.

(21) Appl. No.: 10/157,250

(22) Filed: May 28, 2002

(65) Prior Publication Data

US 2003/0221649 A1 Dec. 4, 2003

(51) Int. Cl.
*F01L 9/02* (2006.01)

(52) U.S. Cl. ..... 123/90.12; 123/196 CP; 123/198 F

(58) Field of Classification Search ..... 123/90.33, 123/90.35, 90.38, 90.39, 90.4, 90.41, 90.43, 123/90.44, 90.45, 90.46, 90.52, 90.55, 90.56, 123/90.57

See application file for complete search history.

(56) References Cited

U.S. PATENT DOCUMENTS

| | | | | |
|---|---|---|---|---|
| 3,782,357 A | | 1/1974 | Kuhn et al. | |
| 3,998,199 A | | 12/1976 | Mechior | |
| 4,441,465 A | | 4/1984 | Nakamura | |
| 4,644,914 A | | 2/1987 | Morita et al. | |
| 4,928,641 A | | 5/1990 | Niizato et al. | |
| 4,976,230 A | | 12/1990 | Voigt | |
| 5,161,495 A | | 11/1992 | Saito | |
| 5,195,472 A | | 3/1993 | Jacques et al. | |
| 5,220,891 A | | 6/1993 | Nakamura et al. | |
| 5,431,133 A | * | 7/1995 | Spath et al. | 123/90.16 |
| 5,503,121 A | * | 4/1996 | Speil et al. | 123/90.22 |
| 5,752,866 A | * | 5/1998 | Takahashi et al. | 440/88 L |
| 5,913,293 A | | 6/1999 | Ochiai | |
| 6,173,689 B1 | * | 1/2001 | Tanaka | 123/90.34 |
| 6,460,499 B1 | * | 10/2002 | Mason et al. | 123/90.55 |
| 6,513,471 B1 | * | 2/2003 | Hicks | 123/90.16 |
| 6,681,734 B1 | * | 1/2004 | Albertson | 123/90.16 |

FOREIGN PATENT DOCUMENTS

JP 61-173706 10/1986

* cited by examiner

*Primary Examiner*—Thomas Denion
*Assistant Examiner*—Ching Chang
(74) *Attorney, Agent, or Firm*—Quarles & Brady LLP

(57) ABSTRACT

An apparatus and method for providing lubricant to a plurality of hydraulic lifters in an internal combustion engine is disclosed, in which the amount of gas bubbles present in the lubricant provided to the lifters is reduced or eliminated so that lifter noise is reduced or prevented. The apparatus, which is part of an internal combustion engine that includes valve trains with hydraulic lifters that are positioned proximate the crankcase and one another, includes a lifter feed gallery that receives lubricant from a feed passage, and communicates the lubricant to lifter feed holes. The lifter feed holes in turn communicate the lubricant to the respective hydraulic lifters. At or near the top of the lifter feed gallery proximate where the feed passage is coupled to the gallery is a single bleed orifice, which diverts gas bubbles away from the gallery and into the crankcase.

17 Claims, 5 Drawing Sheets

HYDRAULIC LIFTER FEED GALLERY WITH AERATION REMOVAL ORIFICE

FIELD OF THE INVENTION

The present invention relates to internal combustion engines. In particular, the present invention relates to lifter feed galleries used to provide oil to multiple hydraulic lifters associated with multiple valve trains of such internal combustion engines.

BACKGROUND OF THE INVENTION

Internal combustion engines commonly employ hydraulic lifters (also called followers or tappets) within their valve trains. The hydraulic lifters are intended to reduce or eliminate lash within the valve trains. That is, the hydraulic lifters adjust in their length to compensate for small amounts of space that can arise between the valves of the engine and their valve seats (on the cylinder heads) due to changes in the operating temperature of the engine and other factors. Without compensating for this lash, the valve trains can result in early, late or otherwise improper opening and closing of the valves.

Referring to FIG. 1 (Prior Art), a flow diagram schematically shows how, in one exemplary embodiment, oil or other lubricant is pumped in an engine from an oil pump 10 to four hydraulic lifters 12,14,16 and 18. Specifically, oil is provided from the oil pump 10 to an oil filter 20, at which the oil is filtered. The oil then is provided both to a flywheel (FW) bearing 22 and (in this embodiment) also to a power takeoff (PTO) bearing 24. From the FW bearing 22, oil is then directed to a camshaft bearing 26, and then to a lifter feed gallery 28. The lifter feed gallery 28 in turn is capable of providing the oil simultaneously to all of the four hydraulic lifters 12,14,16 and 18. In the present embodiment, the hydraulic lifters 12 and 14 form a pair of lifters, with the former hydraulic lifter being an intake lifter and the latter being an exhaust lifter. Similarly, the hydraulic lifters 16 and 18 form a pair, with the former being an intake lifter and the latter being an exhaust lifter.

Referring to FIG. 2 (Prior Art), a valve train 30 employing the hydraulic lifters 12,14 is shown in detail. As shown, a gear 32 is rotated by a crankshaft (not shown) within the engine crankcase (also not shown), and causes cams 34,36, 38 and 40 to rotate. The cams 34,36,38 and 40 are positioned within the engine crankcase. Bottom sides 42,44 of the hydraulic lifters 12,14 rest upon two of the cams 36 and 40, respectively, while push rods 46,48 in turn rest upon top sides 52,54 of the hydraulic lifters, respectively. The opposite ends of the push rods 46,48 in turn interface respective rocker arms 56,58, the opposite sides of which interface valves 62,64. Springs 50,60 between the respective rocker arms 56,58 and the crankcase (not shown) tend to maintain the valves 62,64 in closed positions and tend to force the push rods 46,48 and hydraulic lifters 12,14 toward the cams 36,40. The valves 62,64 are opened when large lobes 66 of the cams 36,40 encounter the hydraulic lifters 12,14.

The hydraulic lifters 12,14 themselves rest within cavities within the engine. When oil is provided to those cavities, oil collects within oil grooves 72, 74 along the sides of the respective hydraulic lifters 12,14, and further enters into the hydraulic lifters by way of oil holes 76,78 located within the respective oil grooves. Operation of the hydraulic lifters 12,14 including the oil to eliminate lash occurring in the valve train is well known to ordinary persons skilled in the art.

Turning to FIG. 3 (Prior Art), a conventional lifter feed gallery 28 is configured for operation in conjunction with valve trains of the type discussed above, that is, in which cams are situated within the engine crankcase and their movement controls the opening and closing of valves by way of hydraulic lifters, push rods and rocker arms. As shown, the lifter feed gallery 28 includes oil 70 that flows into the lifter feed gallery from the camshaft bearing 26 by way of an oil feed passage 80. The oil 70 in turn flows through the lifter feed gallery 28 into four lifter feed holes 82,84,86 and 88 and then flows, by way of those holes, to the four hydraulic lifters 12,14,16 and 18. (The direction of flow of oil into and out of the lifter feed gallery 28 by the oil feed passage 80 and the lifter feed holes 82,84,86 and 88 is indicated by dots indicating inward flow and crosses indicating outward flow.)

As shown, when positioned on an engine for normal operation, the lifter feed gallery 28 is essentially an inverted U-shaped channel, in which the bottom of the U is directed upward, and the oil feed passage 80 is located at the top of the lifter feed gallery. Also as shown, when the lifter feed gallery 28 is in its normal orientation (e.g., the engine is not tipped), one of the lifter feed holes 82 of the lifter feed gallery is located slightly above the oil feed passage 80, while the remaining lifter feed holes 84,86 and 88 are all located below the oil feed passage.

The lifter feed gallery 28 is specifically designed for engines that employ valve trains of the type shown FIG. 2, in which the hydraulic lifters 12,14,16 and 18 are located proximate the engine crankcase and proximate one another, rather than proximate the different valve seats of the different engine cylinders. It is in this type of engine that a single lifter feed gallery 28 can provide the oil 70 to multiple hydraulic lifters 12,14,16 and 18 by way of the short lifter feed holes 82,84,86 and 88.

Although the hydraulic lifters 12,14,16 and 18 often operate well in preventing or diminishing lash within the valve trains of the engine, this is not always the case. Sometimes, the hydraulic lifters fail to sufficiently reduce lash and produce lifter noise or chatter. The lifter noise particularly occurs when the valves close at points in the profiles of the cams 34,36,38 and 40 where the seating velocities are quite high. Utility engines having relatively high operating temperatures (and fuel dilution), as well as vertical crankshaft engines having hydraulic lifters that are oriented in a relatively horizontal manner within the valve trains of the engine, are particularly susceptible to this lifter noise. Also, lifter noise can be exacerbated within utility engines that are employed in machinery such as lawnmowers, which are often operated at angles that are significantly off of the horizontal and experience significant jostling as the machinery moves about.

It would therefore be advantageous if an improved oil feed system for hydraulic lifters could be designed that eliminated or reduce lifter noise and improved lifter performance. It would further be advantageous if such an improved oil feed system could be implemented in engines having valve trains as described above. In particular, it would be advantageous if such an improved oil feed system required only minor modifications from existing oil feed systems and therefore could be simply and cost-effectively manufactured.

SUMMARY OF THE INVENTION

The present inventors have realized that lifter noise and improper operation is largely if not entirely due to the existence of significant amounts of gas bubbles within the oil being provided to the hydraulic lifters. Specifically, because of the passage of the oil through the variety of components discussed above with respect to FIG. 1, as well as the various passages coupling those components, gases such as air that are entrained in the oil can separate from the oil and become bubbles. These gas bubbles can flow through the lifter feed holes 82,84,86 and 88 to the respective hydraulic lifters 12,14,16 and 18. If excessive amounts of gas bubbles are provided to the hydraulic lifters 12,14,16 and 18, the hydraulic lifters become excessively compressible such that the valves controlled by the hydraulic lifters (e.g., the valves 62 and 64) close against their respective valve seats (not shown) earlier than designed, resulting in lifter noise. The lifter noise resulting from gas bubbles being provided to the hydraulic lifters is exacerbated within engines in which the hydraulic lifters are oriented in a horizontal manner, as well as within engines that have higher operating temperatures, greater fuel dilution, and greater tendencies to be operated at angles off of the horizontal such that greater amounts of bubbles occur within the oil.

Thus, to solve the problem of lifter noise and improper lifter operation, it is desirable to reduce or eliminate the gas bubbles existing within the oil being provided to the lifters. Having realized this problem, the inventors have further realized that, in order to achieve such reductions in the gas bubbles within the oil, the lifter feed gallery can be provided with a bleed orifice that couples the lifter feed gallery to the inside of the crankcase of the engine. The bleed orifice is positioned proximate the top of the lifter feed gallery, adjacent to the oil feed passage and above all of the lifter feed holes. As the oil or other lubricant flows into the lifter feed gallery from the oil feed passage and towards the lifter feed holes, the gas bubbles separating from the oil are purged into the crankcase by way of the bleed orifice. Consequently, the oil provided to the hydraulic lifters by way of the lifter feed holes is largely, if not entirely, free of gas bubbles such that the hydraulic lifters no longer experience significant lifter noise.

In particular, the present invention relates to an internal combustion engine that includes a first cylinder configured to support a first piston, a first valve train, and first, second, third and fourth channels. The first valve train includes a first cam and additionally includes a first valve, a first rocker arm, a first push rod, and a first hydraulic lifter. The first rocker arm has first and second sides, where the first side is coupled to the first valve. The first push rod has first and second ends, where the first end is coupled to the second side of the first rocker arm. The first hydraulic lifter has a first face that is coupled to the second end of the first push rod and a second face that interfaces the first cam, where rotation of the first cam causes movement of the first hydraulic lifter and movement of the first valve. The first channel provides lubricant, the second channel is coupled to the first channel, and the third channel couples the second channel to the first hydraulic lifter. The second channel communicates the lubricant to the third channel upon receiving the lubricant from the first channel, and the third channel communicates the lubricant to the first hydraulic lifter upon receiving the lubricant from the second channel. The fourth channel couples the second channel with an internal cavity of a crankcase of the internal combustion engine. A portion of gases communicated along with the lubricant exit the second channel into the internal cavity.

The present invention further relates to a system for providing lubricant to a plurality of hydraulic lifters in an internal combustion engine. The system includes a feed passage configured to receive the lubricant, a lifter feed gallery coupled to the feed passage, and a plurality of lifter feed holes coupling the lifter feed gallery to the plurality of hydraulic lifters, respectively. The system additionally includes means for removing gas from the lubricant as the lubricant is communicated within the lifter feed gallery.

The present invention additionally relates to a method of providing lubricant to a plurality of hydraulic lifters in an internal combustion engine. The method includes providing the lubricant and gas bubbles flowing along with the lubricant into a lifter feed gallery from a feed passage coupled to the lifter feed gallery at a first location, and diverting at least some of the gas bubbles flowing along with the lubricant out of the lifter feed gallery through an orifice and into an internal cavity of a crankcase of the internal combustion engine. The method further includes directing the lubricant to the plurality of hydraulic lifters by way of a plurality of respective lifter feed passages that are coupled to the lifter feed gallery at a plurality of respective additional locations. The orifice is along a top of the lifter feed gallery, and the orifice is at a higher position along the lifter feed gallery than each of the additional locations at which the respective lifter feed passages are coupled to the lifter feed gallery.

DETAILED DESCRIPTION OF THE PREFERRED EMBODIMENT

Figure 4:
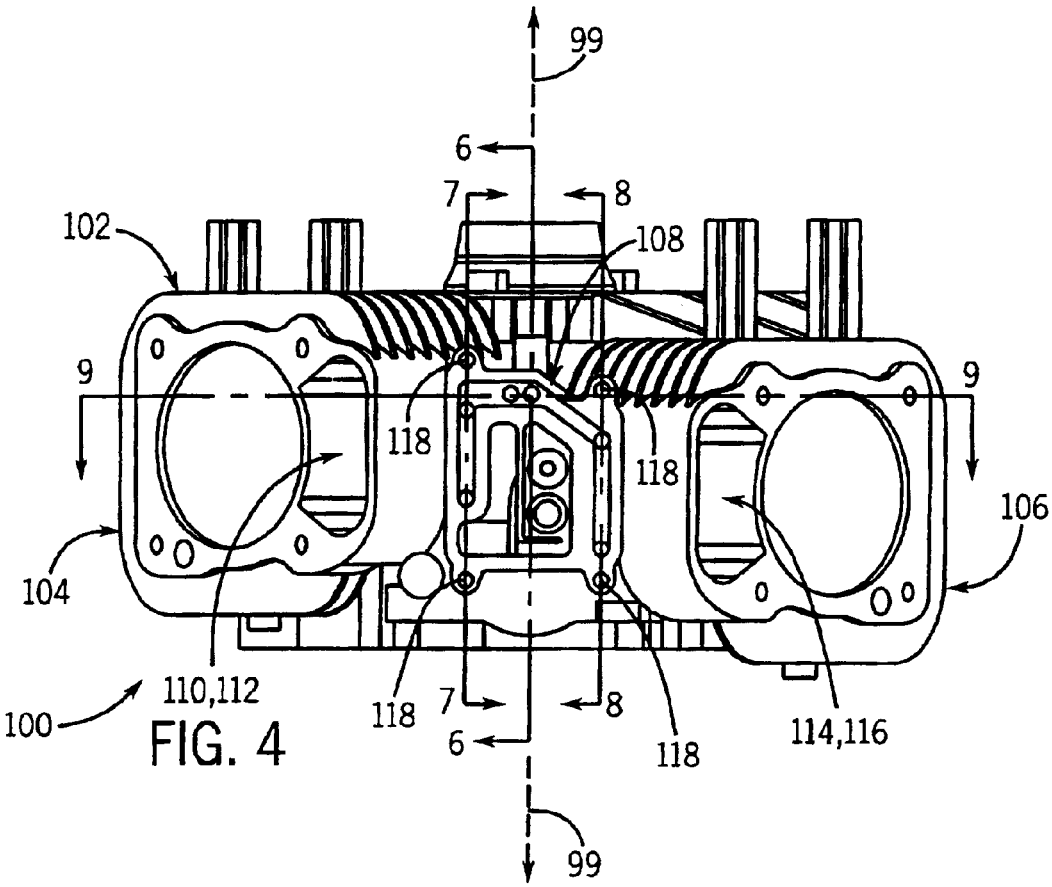
FIG. 4 is an exemplary elevation view of components of an internal combustion engine that employs a lifter feed gallery having a bleed orifice in accordance with one embodiment of the present invention.

Referring to FIG. 4, components of an exemplary two-cylinder internal combustion engine 100 such as the CV25 Command Twin engine manufactured by Kohler Company of Kohler, Wis. include a crankcase 102, first and second cylinders 104 and 106, respectively, and a lifter feed gallery 108. In the present embodiment, the cylinders 104,106 are positioned in a V relative to one another. Also, the first cylinder 104 is positioned slightly higher along a vertical axis 99 than the second cylinder 106, since the cylinders are intended to house pistons (not shown) that are coupled at different axial positions along the crankshaft (not shown). Although FIG. 4 shows only some of the components of the engine 100, the engine when fully assembled also includes a plate (not shown) that is attached to the crankcase 102 over the lifter feed gallery 108 by way of bolts through bolt holes 118, such that the lifter feed gallery is a fully-enclosed channel.

Figure 1:
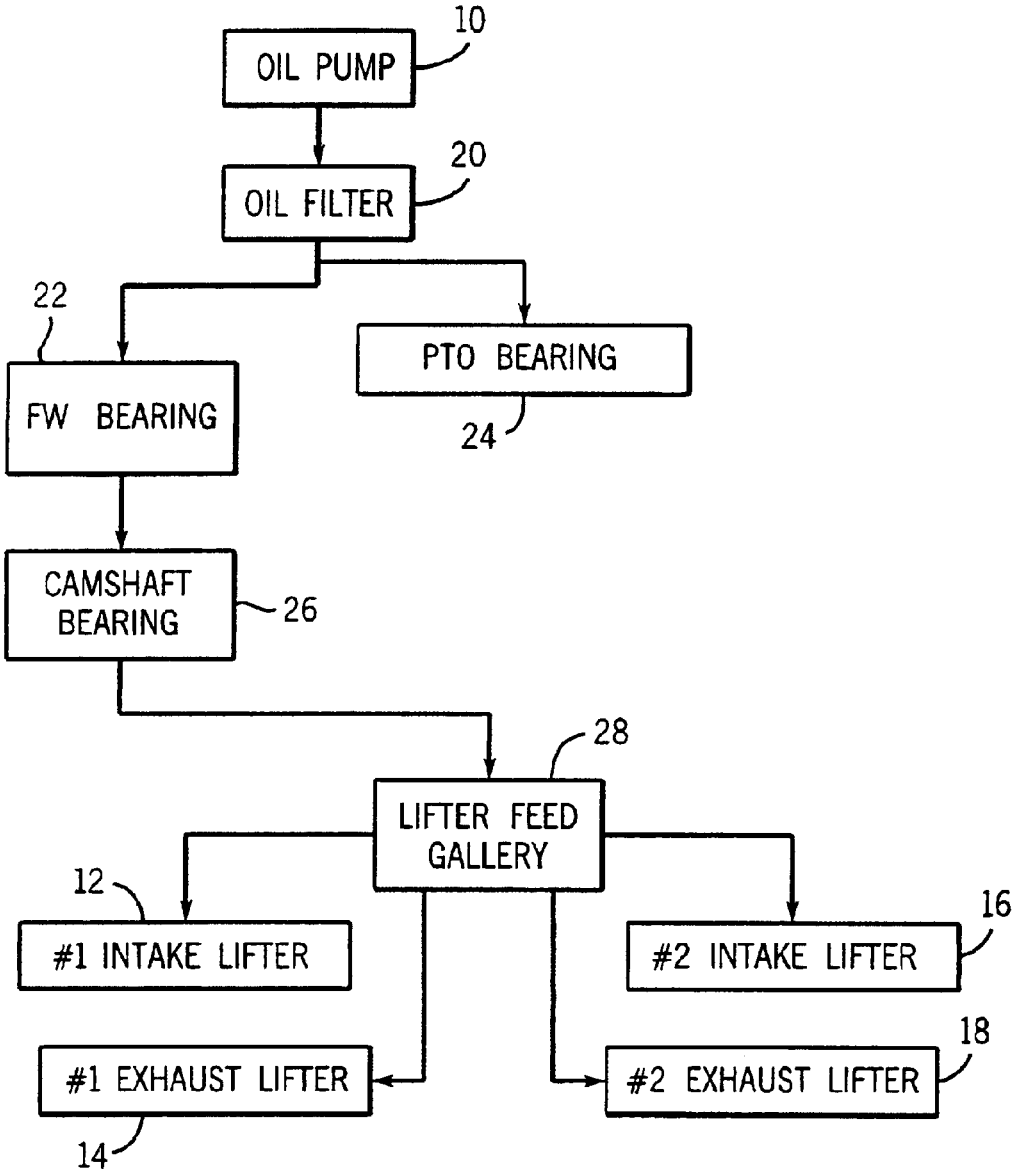
FIG. 1 PRIOR ART
FIG. 1 (Prior Art) is a schematic flow diagram showing a manner of channeling oil within an engine from an oil pump to hydraulic lifters.
Figure 2:
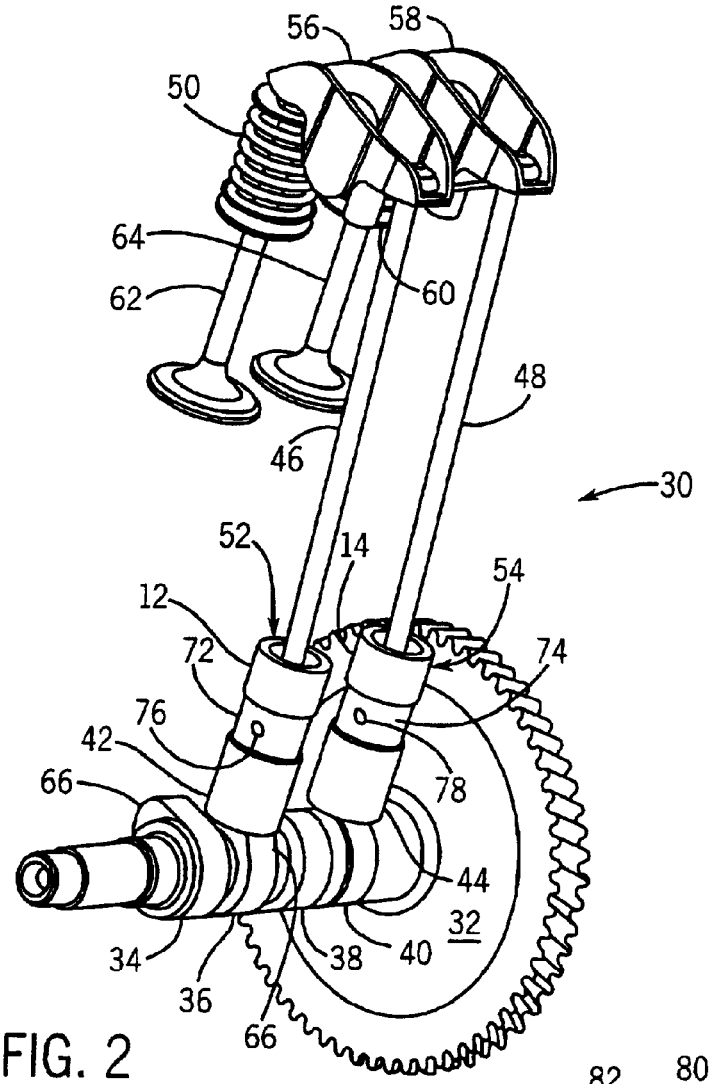
FIG. 2 PRIOR ART
FIG. 2 (Prior Art) is a perspective, elevation view of components of an exemplary valve train employing hydraulic lifters.

Also within the engine 100 adjacent each of the cylinders 104,106 are cavities 110,112,114 and 116 (see also FIGS. 7–8) for housing and supporting hydraulic lifters and push rods identical to those discussed with respect to FIGS. 1 and 2. That is, the cavities 110,112 associated with the cylinder 104 are respectively intended to house the intake hydraulic lifter 12 and the exhaust hydraulic lifter 14 (and associated push rods), and the cavities 114,116 associated with the cylinder 106 are respectively intended to house the intake hydraulic lifter 16 and the exhaust hydraulic lifter 18. Because the cavities 110,112,114 and 116 and the hydraulic lifters 12,14,16 and 18 are all positioned proximate the crankcase 102, it is possible for oil to be provided to each of the hydraulic lifters by way of the single, centrally-positioned lifter feed gallery 108.

Figure 5:
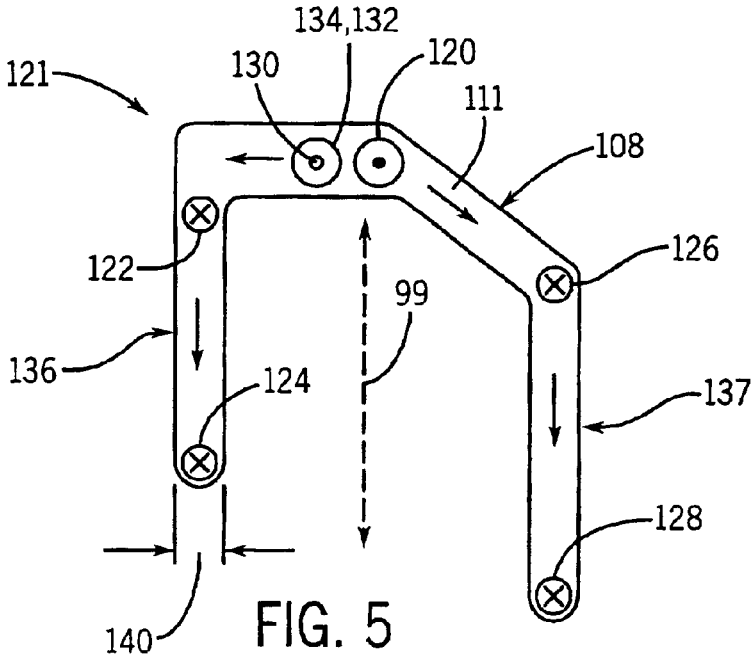
FIG. 5 is an enlarged elevation view of the lifter feed gallery of FIG. 4.

Further referring to FIG. 5, an enlarged elevation view of the lifter feed gallery 108 of FIG. 4 shows the lifter feed gallery to be generally in the shape of an inverted U. The lifter feed gallery 108 receives oil 111 from an oil feed passage 120 at or near a top 121 of the lifter feed gallery (e.g., at the bottom of the U). The oil 111 then flows within the lifter feed gallery 108 through a first arm 136 toward and into first and second lifter feed holes 122 and 124, respectively, and through a second arm 137 toward and into third and fourth lifter feed holes 126 and 128, respectively. Specifically, the oil 111 provided into the first, second, third and fourth lifter feed holes 122,124,126 and 128 is provided to the first, second, third and fourth cavities 110,112,114 and 116, respectively, and thus to the hydraulic lifters 12,14,16 and 18, respectively.

Figure 6:
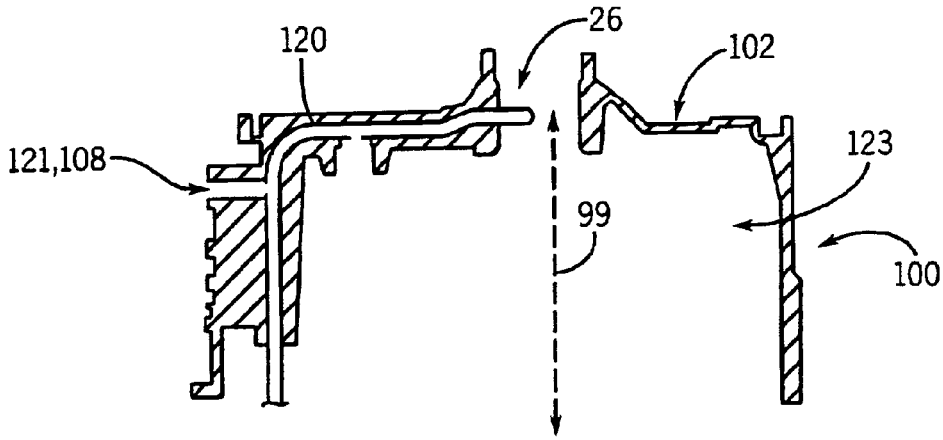
FIGS. 6–9 are sectional views of the internal combustion engine and lifter feed gallery of FIG. 4, taken along respective lines 6—6,7—7,8—8 and 9—9 of FIG. 4.
Figure 7:
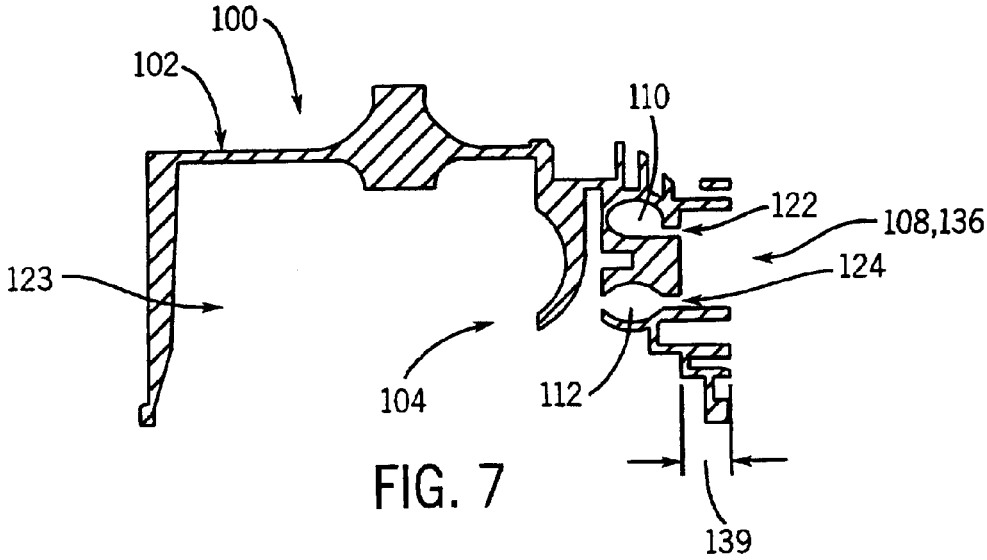
Figure 8:
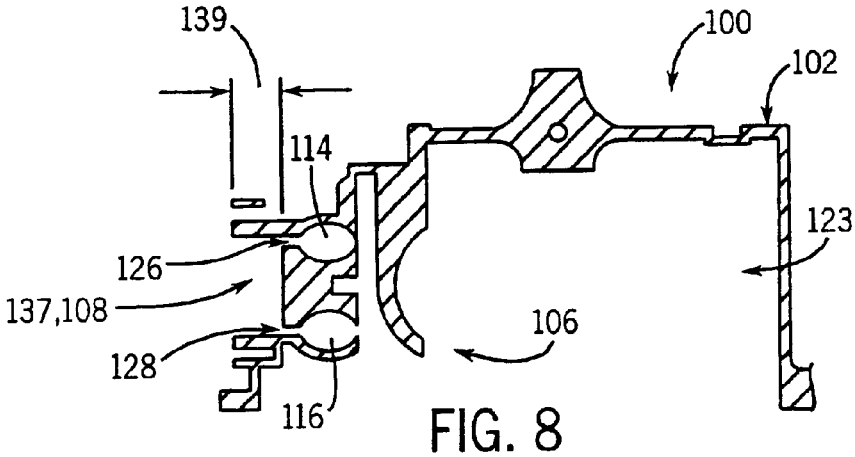

Referring further to FIGS. 6–8, sectional views of the engine 100 show the lifter feed gallery 108, the oil feed passage 120, the lifter feed holes 122,124,126 and 128 and the cavities 110,112,114 and 116 in greater detail. In particular, FIG. 6 is a sectional view of the engine 100 taken along line 6—6 of FIG. 4 that shows how the oil feed passage 120 extends from the camshaft bearing 26 of the engine 100 along the crankcase 102 to the top 121 of the lifter feed gallery 108. FIGS. 7 and 8 are sectional views of the engine 100 taken along lines 7—7 and 8—8 of FIG. 4, respectively. FIG. 7 in particular shows the first and second lifter feed holes 122 and 124 connecting to the first and second cavities 110 and 112, respectively, alongside the cylinder 104, while FIG. 8 in particular shows the third and fourth lifter feed holes 126 and 128 connecting to the third and fourth cavities 114 and 116, respectively, alongside the cylinder 106. Thus, the lifter feed holes 122,124,126 and 128 are positioned so as to be aligned with the respective valve trains of the engine 100.

Referring again to FIG. 5, in accordance with an embodiment of the present invention the lifter feed gallery 108 additionally includes an aeration removal orifice or bleed orifice 130 adjacent to the oil feed passage 120 at or near the top 121 of the lifter feed gallery. The bleed orifice 130 connects the lifter feed gallery 108 to an interior cavity 123 (see FIGS. 6–10) of the crankcase 102. As shown, the bleed orifice 130 is relatively small in diameter and, in the present embodiment is formed by providing a plug 132 into a larger-diameter hole 134 that is casted, drilled/machined or otherwise provided in the lifter feed gallery 108/crankcase 102. The size of the diameter of the bleed orifice 130 is, in the present embodiment, chosen to be sufficiently small (e.g., ½ mm) that the hydraulic pressure within the lifter feed gallery 108 (at, for example, 50 psi) does not drop significantly due to the coupling of the lifter feed gallery with the interior cavity 123 of the crankcase 102 (which is typically at atmospheric pressure, or about 14.7 psi).

Further as shown in FIG. 5, the bleed orifice 130 is at a higher level (relative to the vertical axis 99) than all of the first, second, third and fourth lifter feed holes 122,124,126 and 128. In particular, in comparison with the conventional lifter feed gallery 28 of FIG. 3, the first lifter feed hole 122 is no longer at the top 121 of the lifter feed gallery, but rather is shifted somewhat downward from the top. Placement of the bleed orifice 130 above all of the first, second, third and fourth lifter feed holes 122,124,126 and 128 allows for improved removal of the gas bubbles from the oil 111 since the gas bubbles are for the most part removed from the oil before the oil is provided into the first and second arms 136,137 of the lifter feed gallery 28 and to the lifter feed holes 122,124,126 and 128. Thus, relatively few gas bubbles have to flow past any of the lifter feed holes 122,124,126 and 128 in order to reach the bleed orifice 80.

Figure 9:
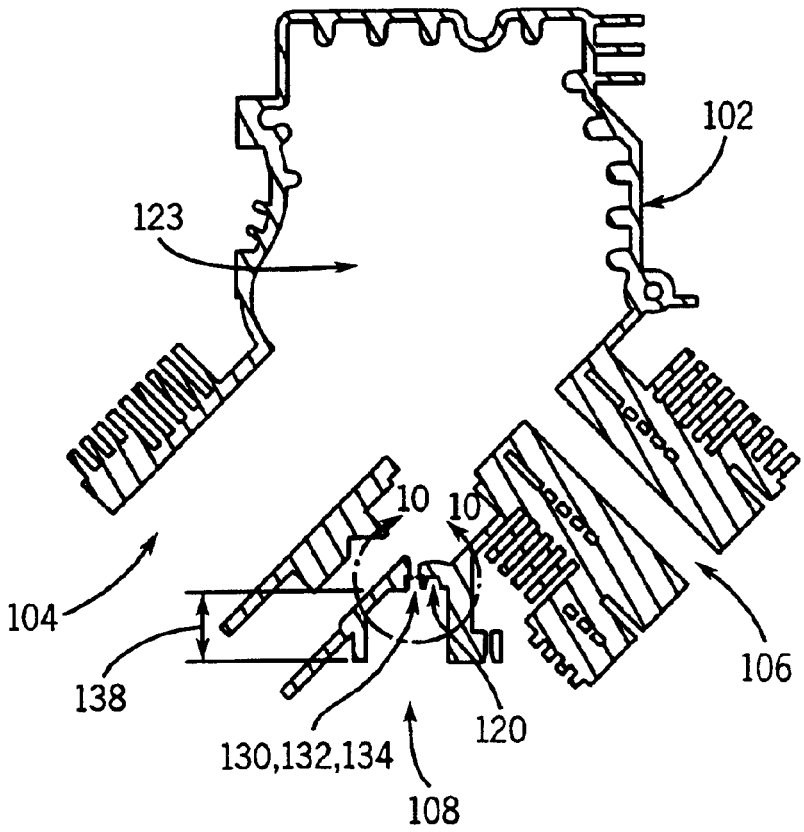
Figure 10:
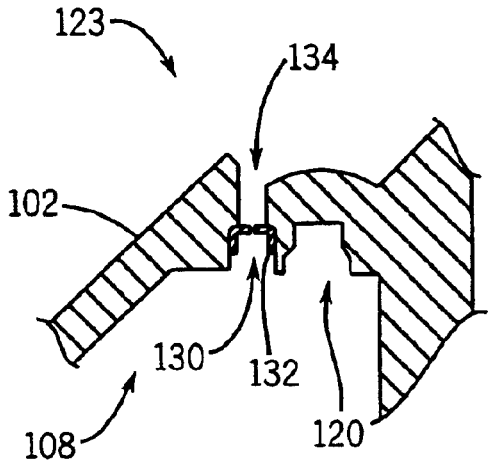
FIG. 10 is an enlarged view of a portion of the sectional view of FIG. 9, which more clearly shows a cross-section of a plug used in the bleed orifice of the lifter feed gallery.

Referring additionally to FIGS. 9 and 10, FIG. 9 provides a sectional view through the engine 100 taken along line 9—9 of FIG. 4, and reveals how the bleed orifice 130 connects the lifter feed gallery 108 with the interior cavity 123 of the crankcase 102. FIG. 10 in turn provides an enlarged view of the portion of FIG. 9 showing the bleed orifice 130 as well as the oil feed passage 120. As shown in FIGS. 9 and 10, the plug 132 rests within the larger diameter hole 134 and creates the smaller-diameter bleed orifice 130. The plug 132 can be made from plastic, metal or a variety of other materials. In alternate embodiments, the bleed orifice 130 can be formed by simply casting, drilling/machining or otherwise providing a hole of the desired diameter into the lifter feed gallery 108/crankcase 102 without utilizing an additional plug. That is, in alternate embodiments the hole 134 (or a different-diameter version thereof) can form the bleed orifice 130.

As shown in FIGS. 4 and 6, the bleed orifice 130, as well as the larger diameter hole 134, are shown to be channels that are substantially (if not perfectly) horizontal, e.g., having central axes that are perpendicular to the vertical axis 99 that is parallel to the direction of gravity during normal operation of the engine 100. However, in alternate embodiments, the bleed orifice 130 and/or hole 134 can take non-horizontal paths in coupling the lifter feed gallery 108 with the interior cavity 123, although typically the vertical levels of the openings at either end of the bleed orifice will be at the same vertical level.

Further from FIGS. 7–9 it is apparent that the lifter feed gallery 108 in the present embodiment has a varying depth in terms of the distance between the positions at which the cover plate (not shown) would attach over the lifter feed gallery and the innermost wall of the lifter feed gallery formed by the crankcase 102. The greatest depth 138 of the lifter feed gallery 108 in the present embodiment occurs proximate the top 121 of the lifter feed gallery at and around the oil feed passage 120 and the bleed orifice 130, as shown in FIG. 9. From there, the depth decreases until a minimum depth 139 is provided along the first and second arms 136,137.

The variation in depth of the lifter feed gallery 108, combined with a relatively constant width 140 (see FIG. 5), results in the lifter feed gallery having a varying cross-sectional area that is at its maximum near the top 121 and at its minimum along the arms 136,137. Further, the cross-sectional area at the top 121 is significantly greater than the cross-section of the oil feed passage 120—e.g., at least two and, in the present embodiment, over 6 times greater. Consequently, the flow rate of the oil 111 is relatively low near the top 121, and this allows the gases entrained in the oil more time and space to settle out of the oil and coalesce into bubbles. Thus, the gas bubbles that exit out of the bleed orifice 130 are predominantly formed and removed at or near the top 121 of the lifter feed gallery 108.

Without a larger cross-sectional area near the top 121, a greater proportion of the gas bubbles would only settle out of the oil while the oil was flowing within the arms 136,137, pass by the lifter feed holes 122,124,126 and 128, and potentially still be directed toward the hydraulic lifters 12,14,16 and 18 rather than flowing upward toward the bleed orifice 130. Further, in such case, a significant amount of the gas would not settle out of the oil 111 due to the rapid flow rate of the oil in the arms 136,137. In alternate embodiments, the shape and depth of the lifter feed gallery 108 can vary from that shown. For example, in one alternate embodiment, the lifter feed gallery would maintain a constant depth at all points along the lifter feed gallery but have a varying width such that the cross-section of the lifter feed gallery was still at its maximum proximate the oil feed passage and the bleed orifice.

Figure 3:
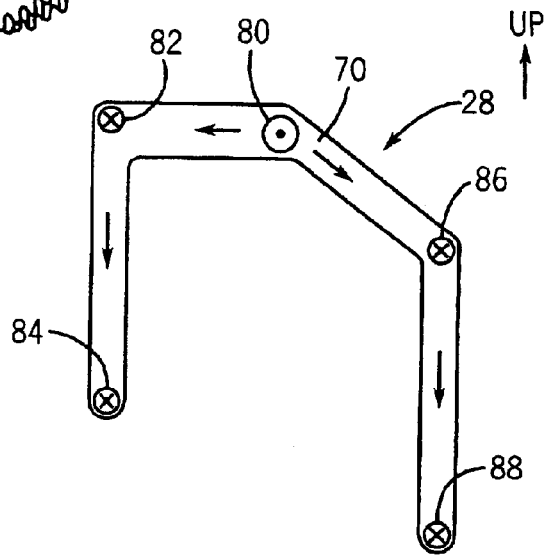
FIG. 3 PRIOR ART
FIG. 3 (Prior Art) is an elevation view of an exemplary lifter feed gallery by which oil is channeled to hydraulic lifters such as those of FIGS. 1 and 2.

Use of the bleed orifice 130 in the lifter feed gallery 108 provides significant advantages relative to the Prior Art embodiment of FIG. 3. In particular, the bleed orifice 130 purges gas bubbles in the oil 111 from the lifter feed gallery 108 into the interior cavity 123 of the crankcase 102, before the oil is fed into the lifter feed holes 122,124,126 and 128 and then to the hydraulic lifters 12,14,16, and 18. By purging the gas bubbles into the interior cavity 123 through the bleed orifice 130, the oil 111 provided to the lifter feed holes 122,124,126 and 128 and the hydraulic lifters 12,14,16 and 18 contains a reduced amount of gas bubbles such that lifter noise is reduced or eliminated.

The present invention including the bleed orifice 130 is also advantageous simple and cost-effective. Because the single lifter feed gallery 108 is able to provide the oil 111 to all (or at least several) of the hydraulic lifters 12,14,16 and 18, the single bleed orifice 130 at the top of the lifter feed gallery 108, as opposed to multiple orifices, more complicated channels, or other components, is sufficient to provide significant reduction of the gas bubbles in the oil 111.

During operation, it is common for at least some of the oil 111 to exit the lifter feed gallery 108 through the bleed orifice 130 and flow into the interior cavity 123 in addition to the gas bubbles that are purged from the oil. The bleed orifice 130 is connected to the interior cavity 123 in part so that this oil that exits through the bleed orifice is returned to the engine sump. In alternate embodiments, the bleed orifice 130 could be connected to a different portion of the engine 100 other than the interior cavity 123, although typically it is still desirable that the bleed orifice be connected to a portion of the engine by which it is possible to return to the oil to the sump/hydraulic system of the engine.

In alternate embodiments, a variety of features of the lifter feed gallery 108 and other components shown in FIGS. 4–10 can be varied from that shown in FIGS. 4–10. For example, in one alternate embodiment, the lifter feed gallery is employed in other types of engines such as four-cylinder engines. In such embodiments, the lifter feed gallery could have eight lifter feed holes, which could be distributed along one, two, or more than two arms of the lifter feed galley rather than the two arms of the inverted-U-shaped embodiment shown above in FIGS. 4–5.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. An internal combustion engine comprising:

a first cylinder configured to support a first piston;

a first valve train including a first cam and further including a first valve;

a first rocker arm having first and second sides, wherein the first side is coupled to the first valve;

a first push rod having first and second ends, wherein the first end is coupled to the second side of the first rocker arm; and a first hydraulic lifter having a first face that is coupled to the second end of the first push rod and a second face that interfaces the first cam, wherein rotation of the first cam causes movement of the first hydraulic lifter and movement of the first valve;

a first channel that provides lubricant;

a second channel coupled to the first channel;

a third channel coupling the second channel to the first hydraulic lifter, wherein the second channel communicates the lubricant to the third channel upon receiving the lubricant from the first channel, and wherein the third channel communicates the lubricant to the first hydraulic lifter upon receiving the lubricant from the second channel; and a fourth channel coupling the second channel with an internal cavity of a crankcase of the internal combustion engine, wherein a portion of gases communicated along with the lubricant exit the second channel into the internal cavity.

2. The internal combustion engine of claim 1, wherein the fourth channel is a bleed orifice that has a central axis that is substantially horizontal, and wherein the second channel has a larger cross-section proximate the first and fourth channels than proximate the third channel.

3. The internal combustion engine of claim 1, wherein the fourth channel is coupled to the second channel at a first location adjacent to a second location where the first channel is coupled to the second channel.

4. The internal combustion engine of claim 3, wherein the fourth channel is approximately parallel to at least a portion of the first channel, and wherein the first location is at the same height as the second location.

5. The internal combustion engine of claim 3, wherein the first location at which the fourth channel is coupled to the second channel is physically higher than a third location at which the third channel is coupled to the second channel.

6. The internal combustion engine of claim 1, further comprising:

a second valve train that includes a second cam and further includes a second valve;

a second rocker arm having third and fourth sides, wherein the third side is coupled to the second valve;

a second push rod having third and fourth ends, wherein the third end is coupled to the fourth side of the second rocker arm; and a second hydraulic valve having a third face that is coupled to the fourth end of the second push rod and a fourth face that interfaces the second cam, wherein rotation of the second cam causes movement of the second hydraulic lifter and movement of the second valve.

7. The internal combustion engine of claim 6, wherein the second channel is a lifter feed gallery that includes at least a top portion at which the first and fourth channels are coupled to the second channel, and a first arm that extends physically downward from the top portion.

8. The internal combustion engine of claim 7, further comprising a fifth channel coupling the second channel to the second hydraulic lifter, wherein the second channel communicates the lubricant to the fifth channel upon receiving the lubricant from the first channel, wherein the fifth channel communicates the lubricant to the second hydraulic lifter upon receiving the lubricant from the second channel, and wherein the fifth channel is coupled to the second channel at a first location along the first arm that is lower than a second location along the first arm at which the third channel is coupled to the second channel, wherein both the first and second locations are positioned physically below the top portion of the second channel.

9. The internal combustion engine of claim 8, further comprising:

a second cylinder configured to support a second piston; and third and fourth valve trains respectively including third and fourth valves capable of being opened and closed in relation to the second cylinder;

third and fourth cams;

third and fourth push rods;

third and fourth rocker arms coupled between the third and fourth push rods, respectively, and the third and fourth valves, respectively; and third and fourth hydraulic lifters coupled to the third and fourth push rods, respectively, and interfacing the third and fourth cams, respectively.

10. The internal combustion engine of claim 9, wherein the second channel has an inverted-U shape, wherein the first arm and a second arm of the second channel extend downward on first and second sides of the top portion of the second channel, and wherein sixth and seventh channels are coupled between the second arm and the third and fourth hydraulic lifters, respectively.

11. The internal combustion engine of claim 10, wherein the third, fifth, sixth and seventh channels respectively empty into first, second, third and fourth cavities within which are the first, second, third and fourth hydraulic lifters.

12. The internal combustion engine of claim 1, wherein the fourth channel is formed at least in part as an orifice within a plug, which in turn is supported within a larger channel in a crankcase of the engine.

13. The internal combustion engine of claim 1, wherein the lubricant is oil, and the first channel is an oil feed passage coupling the second channel to a camshaft bearing, which in turn is coupled to an oil pump by way of an oil filter and a flywheel bearing.

14. A method of providing lubricant to a plurality of hydraulic lifters in an internal combustion engine, the method comprising:

providing the lubricant and gas bubbles flowing along with the lubricant into a lifter feed gallery from a feed passage coupled to the lifter feed gallery at a first location;

diverting at least some of the gas bubbles flowing along with the lubricant out of the lifter feed gallery through an orifice and into an internal cavity of a crankcase of the internal combustion engine; and directing the lubricant to the plurality of hydraulic lifters by way of a plurality of respective lifter feed passages that are coupled to the lifter feed gallery at a plurality of respective additional locations, wherein the orifice is along a top of the lifter feed gallery, at a higher position along the lifter feed gallery than each of the additional locations at which the respective lifter feed passages are coupled to the lifter feed gallery.

15. The method of claim 14, wherein the lifter feed gallery has a pair of arms coupled to a top so that the lifter feed gallery is in the shape of an inverted U, and wherein the lifter feed gallery has a smaller cross-section along the arms than at the top.

16. The method of claim 14, wherein at least a portion of the lubricant is also diverted into the internal cavity of the crankcase.

17. The method of claims 14, wherein the orifice is formed within a plug, which in turn is supported within an additional orifice formed within a wall of the crankcase.

* * * * *